US007564003B2

(12) United States Patent
Hu et al.

(10) Patent No.: US 7,564,003 B2
(45) Date of Patent: Jul. 21, 2009

(54) DETECT SWITCH HAVING AN IMPROVED MOVEABLE CONTACT

(75) Inventors: Yong-Hui Hu, ShenZhen (CN); Yusho Nakase, Yokohama (JP)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 182 days.

(21) Appl. No.: 11/879,275

(22) Filed: Jul. 16, 2007

(65) Prior Publication Data

US 2008/0073193 A1 Mar. 27, 2008

(30) Foreign Application Priority Data

Jul. 14, 2006 (TW) ..... 95212387 U

(51) Int. Cl.
*H01H 5/18* (2006.01)

(52) U.S. Cl. ..... 200/406; 200/516

(58) Field of Classification Search ..... 200/310–314, 200/341–345, 406, 516
See application file for complete search history.

(56) References Cited

U.S. PATENT DOCUMENTS 7,202,429 B2 * 4/2007 Bouvier et al. ..... 200/310
7,235,754 B2 * 6/2007 Rochon et al. ..... 200/406
7,279,652 B2 * 10/2007 Genz et al. ..... 200/406
7,331,805 B1 * 2/2008 Hu ..... 439/188
7,429,707 B2 * 9/2008 Yanai et al. ..... 200/1 B

FOREIGN PATENT DOCUMENTS

WO WO2005/027163 3/2005

* cited by examiner

*Primary Examiner*—Michael A Friedhofer
*Assistant Examiner*—Lisa N Klaus
(74) *Attorney, Agent, or Firm*—Wei Te Chung

(57) ABSTRACT

A detect switch (100) includes an insulative housing (2), a first, a second, a third and a fourth fixed terminals (11, 12, 13, 14), a moveable contact (3) electrically connecting with the third and the fourth fixed terminals, a driving mechanism depressing the moveable contact. The moveable contact has four periphery contact portions (32) each formed with a protrusion (33). One of the protrusions resists against the third fixed terminal in assembly. When the moveable contact is depressed to have a central contact portion (31) thereof contact with the first fixed terminal, the periphery contact portions tilt upwardly to leave away from corresponding fixed terminals for insulating the third and the fourth fixed terminals. The third and first fixed terminals are thereby electrically connected due to an engagement among the moveable contact and themselves.

20 Claims, 8 Drawing Sheets

DETECT SWITCH HAVING AN IMPROVED MOVEABLE CONTACT

BACKGROUND OF THE INVENTION

1. Field of the Invention

The present invention relates to a detect switch, and particularly to a detect switch provided with an electrical member such as a Light Emitting Diode (LED) used in various electronic devices.

2. Description of Related Art

A conventional detect switch provided with a light source is described in WO Patent publication No. 2005/027163 published on Mar. 24, 2005. The detect switch provided with a light source comprises an insulative housing, a plurality of connecting pieces, a central pad, a dome, an operation member moveably retained in the insulative housing, an actuator, a cover attached to a top of the insulative housing, and a sealing sheet interposed between the cover and the insulative housing. The connecting pieces are axially offset relative to each other and define thereon a plurality of conductive regions, which include a plurality of first and second fixed terminals formed thereon. The first fixed terminals are connected to both the light source and the outwardly extending second fixed terminals. The dome has a central contact portion disposed above the central pad and four arms radially extending from the central contact portion. Three of the arms contact with the conductive regions permanently. In operation, when the actuator is pushed downwardly, the central contact portion of the dome is downwardly depressed for contacting with the central pad to thereby establish an electrical connection between the conductive regions via the central pad. When the dome is tilted toward a certain direction, the arms of the dome could be separated from corresponding conductive region, to maintain electrical connection among other conductive regions.

As described above, in order to selectively contact with corresponding conductive regions, the dome should be silted toward a certain direction. However, it is troublesome to perform the operation of silting the dome. Additionally, it is easy to bring an unnecessary engagement between the arms of the dome and the unselected conductive regions, when the dome is silted toward an inaccurate direction.

Hence, an improved detect switch is required to overcome the above-mentioned disadvantages of the related art.

SUMMARY OF THE INVENTION

A primary object of the present invention is to provide a detect switch formed with a moveable contact contacting with selected fixed terminals easily and accurately.

To achieve the aforementioned object, a detect switch comprises an insulative housing, a first, a second, a third and a fourth fixed terminals, a moveable contact electrically connect the third and fourth fixed terminals, a driving mechanism downwardly depressing the moveable contact, and an LED electrical connected to the second fixed terminals. The moveable contact has four periphery contact portions each formed with a protrusion. One of the protrusions resists against the third fixed terminal in assembly. When the moveable contact is depressed to have a central contact portion thereof contact with the first fixed terminal, the periphery contact portions tilt upwardly to leave away from corresponding fixed terminals for insulating the third and the fourth fixed terminals. The third and first fixed terminals are thereby electrically connected due to an engagement among the moveable contact and themselves.

Due to formation and arrangement of the protrusions of the periphery contact portions, the moveable contact could selectively contact with any fixed terminal, under a downward movement of the driving mechanism. It is convenient to drive the moveable contact to deform. Additionally, incorrect operation could be avoided because of the downward movement of the driving mechanism.

Other objects, advantages and novel features of the invention will become more apparent from the following detailed description of a preferred embodiment when taken in conjunction with the accompanying drawings.

DETAILED DESCRIPTION OF THE INVENTION

Figure 1:
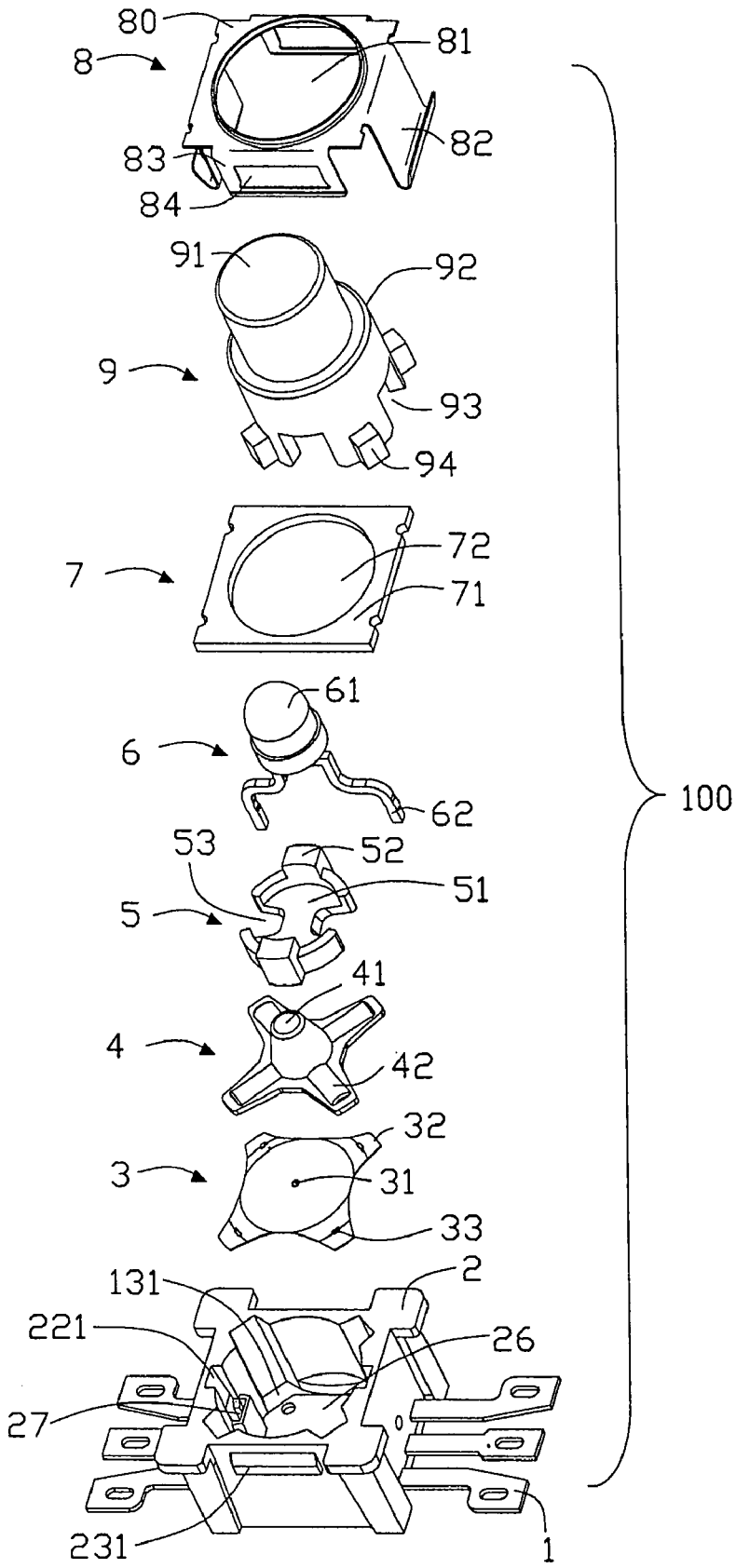
FIG. 1 is an exploded perspective view of a detect switch in accordance with the present invention.

Reference will now be made to the drawing figures to describe the present invention in detail. Referring to FIG. 1, a detect switch 100 in accordance with the preferred embodiment of the present invention is adapted for electrically connecting with an LED 6. In fact, the switch 100 may also be used for other kinds of electrical member in other embodiments. The detect switch 100 comprises an insulative housing 2 defining a cavity 26, a plurality of fixed terminals 1 embedded in the insulative housing 2, a moveable contact 3 retained in the cavity 26 of the insulative housing 2, an operator 4 disposed above the moveable contact 3, a retention portion 5 positioned on the operator 4, an LED 6 located above the retention portion 5, an actuator 9 assembled to the insulative housing 2, a cover 8 attached to a top of the insulative housing 2, and a gasket 7 interposed between the insulative housing 2 and the cover 8.

Figure 3:
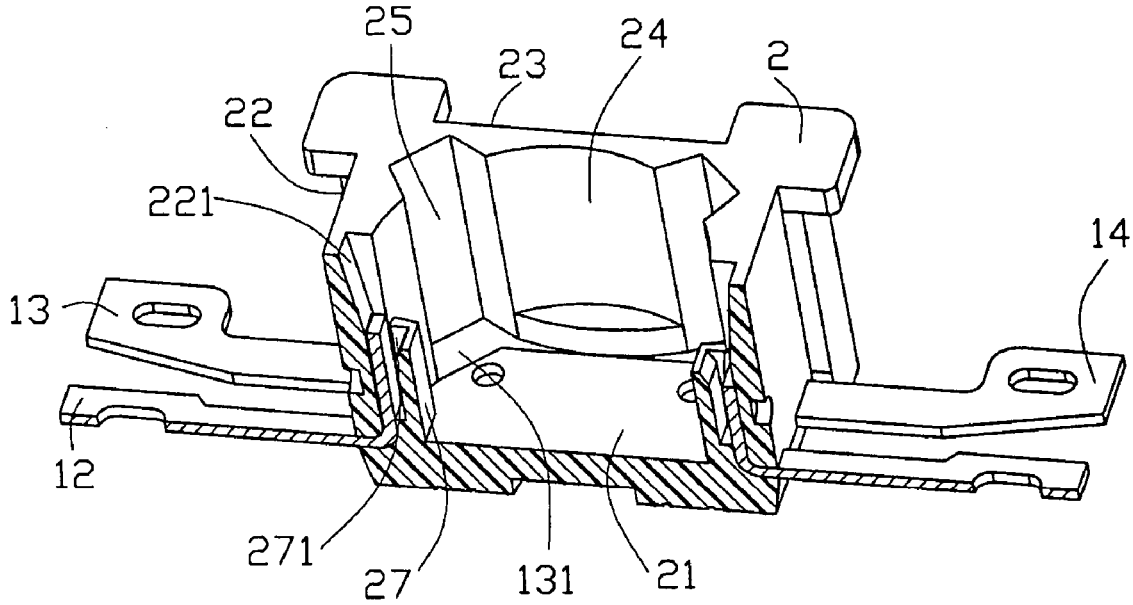
FIG. 3 is a partially perspective view of an insulative housing to which the fixed terminals are assembled.

Referring to FIG. 3 in conjunction with FIG. 1, the insulative housing 2 is a substantially rectangular case, comprising a bottom wall 21, a pair of opposite periphery walls 22 and a pair of opposite side walls 23 raising upwardly from the bottom wall 21 to thereby define the cavity 26 therebetween. Each periphery wall 22 has an engaging slot 221 defined thereon in a top-to-bottom direction. The pair of side walls 23 respectively have a first recess 24 having a semi-curved surface defined in an inner surface thereof and a tuber 231 formed at an outer surface thereof. The cavity 26 has four rectangular second recesses 25 defined at four corners thereof, and a pair of fixing portions 27 respectively surrounding corresponding engaging slots 221. Each fixing portion 27 defines therein an insertion slot 271 communicating with the engaging slot 221.

Figure 2:
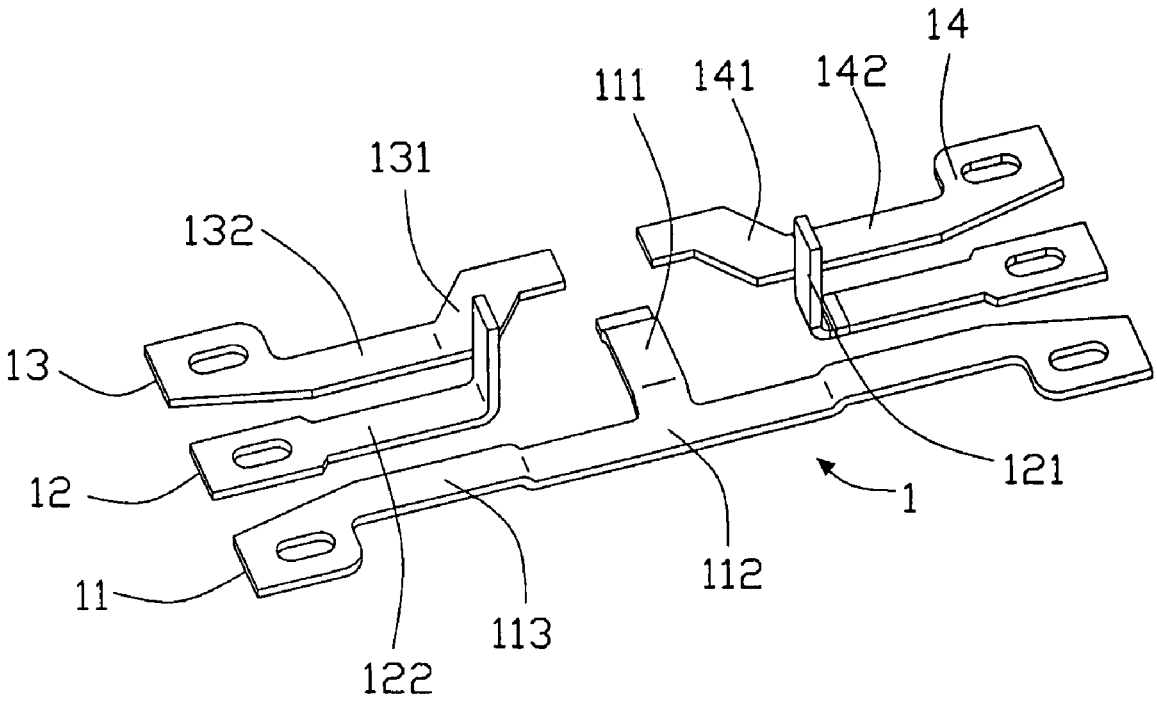
FIG. 2 is a perspective view of a plurality of fixed terminals as shown in FIG. 1.

Referring to FIG. 2, the plurality of fixed terminals 1 comprises a T-shaped first fixed terminal 11, a second fixed terminal 12, a third fixed terminal 13 and a fourth fixed terminal 14. The first fixed terminal 11 is formed with a body portion 112 extending in a longitudinal direction, a pair of first soldering portions 113 extending lengthwise along an extending direction of the body portion 112. The body portion 112 has a first contact portion 111 protruding perpendicularly from a center portion thereof. The second fixed terminal 12 has a pair of second soldering portions 122 extending parallel to the first soldering portions 113, and a pair of second contact portions 121 raising perpendicularly to inner ends of the second soldering portions 122. The third fixed terminal 13 and the fourth fixed terminal 14 respectively have a third soldering portions 132, a fourth soldering portion 142 extending parallel to the second soldering portions 122, a third contact portions 131 and a fourth contact portion 141 bending obliquely from inner ends of corresponding soldering portions 132, 142.

Referring to FIG. 1, the dome-like moveable contact 3 comprises a central contact portion 31 and four periphery contact portions 32 symmetrically radially formed around the central contact portion 31. Each periphery contact portion 32 is provided with a protrusion 33 projecting downwardly from a substantially central portion thereof.

The operator 4 comprises a button 41 having a beveled surface and four projection beams 42 projecting radially from a lower portion of the button 41.

The retention portion 5 is formed with a body portion 51 having a curved outer surface for corresponding to the first recesses 24, a pair of indentations 53 symmetrically defined thereon, and a pair of engaging portions 52 symmetrically formed at an outer surface of the body portion 51.

The LED 6 comprises a light source 61 and a pair of substantially Z-shaped cantilevered arms 62 extending downwardly from the light source 61 for insertion into the insertion slots 271 of the insulative housing 2.

The actuator 9 comprises a cylindrical base portion 92, and an upper portion 91 having a diameter smaller than that of the base portion 92. The base portion 92 has four protrusions 94 symmetrically formed around an outer surface thereof, and four cutouts 93 each defined between a pair of adjacent protrusions 94.

The cover 8 comprises a top face 80 defining an extension hole 81, a pair of periphery faces 82 extending downwardly from a pair of opposite sides of the top face 80, and a pair of bent portions 83 bent perpendicularly to another pair of opposite sides of the top face 80. Each bent portion 83 has an engaging groove 84 defined thereon for engaging with the tubers 231 of the insulative housing 2.

The gasket 7 is substantially a rectangular board, comprising a board portion 71 and a circular mounting hole 72 defined therein.

Figure 4:
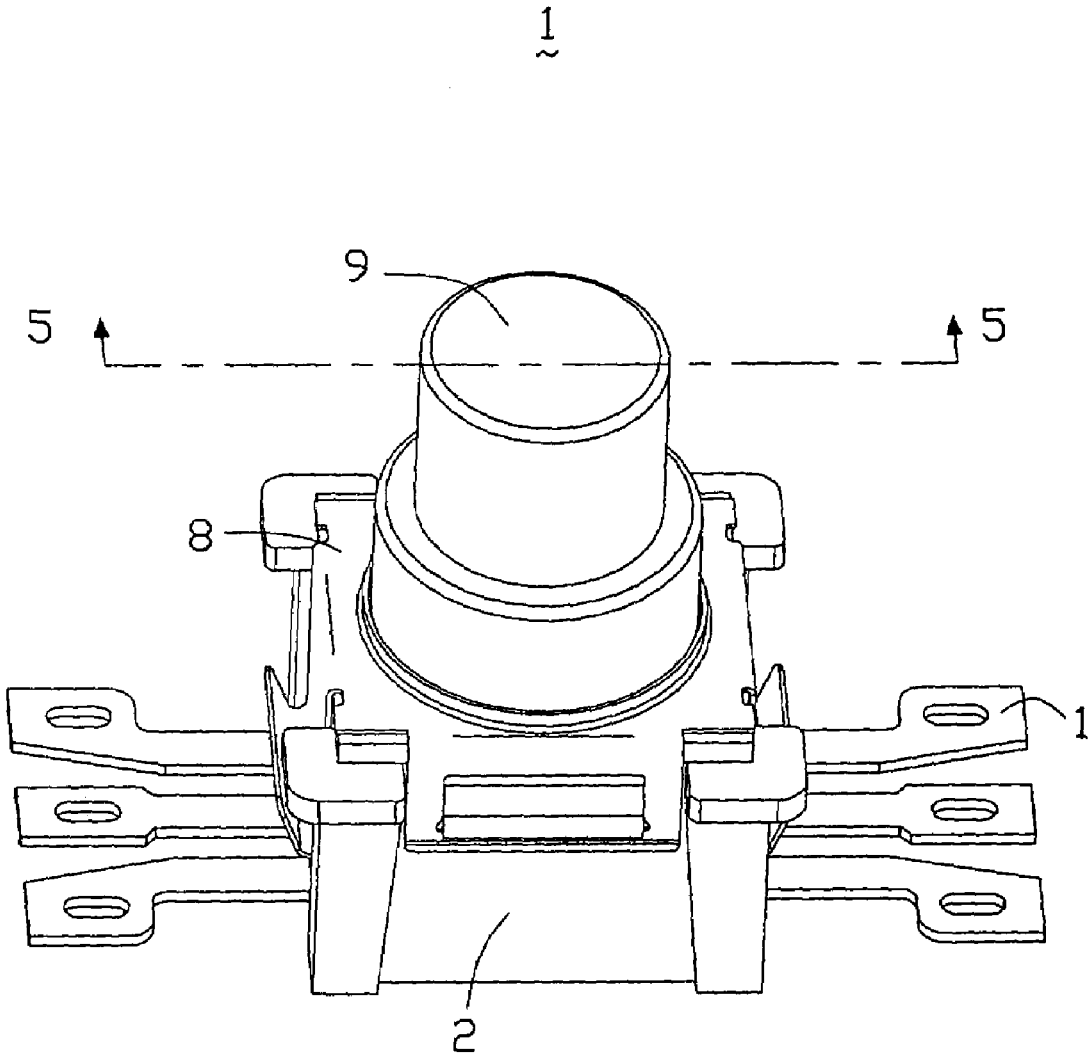
FIG. 4 is an assembled perspective view of the detect switch as shown in FIG. 1.
Figure 5:
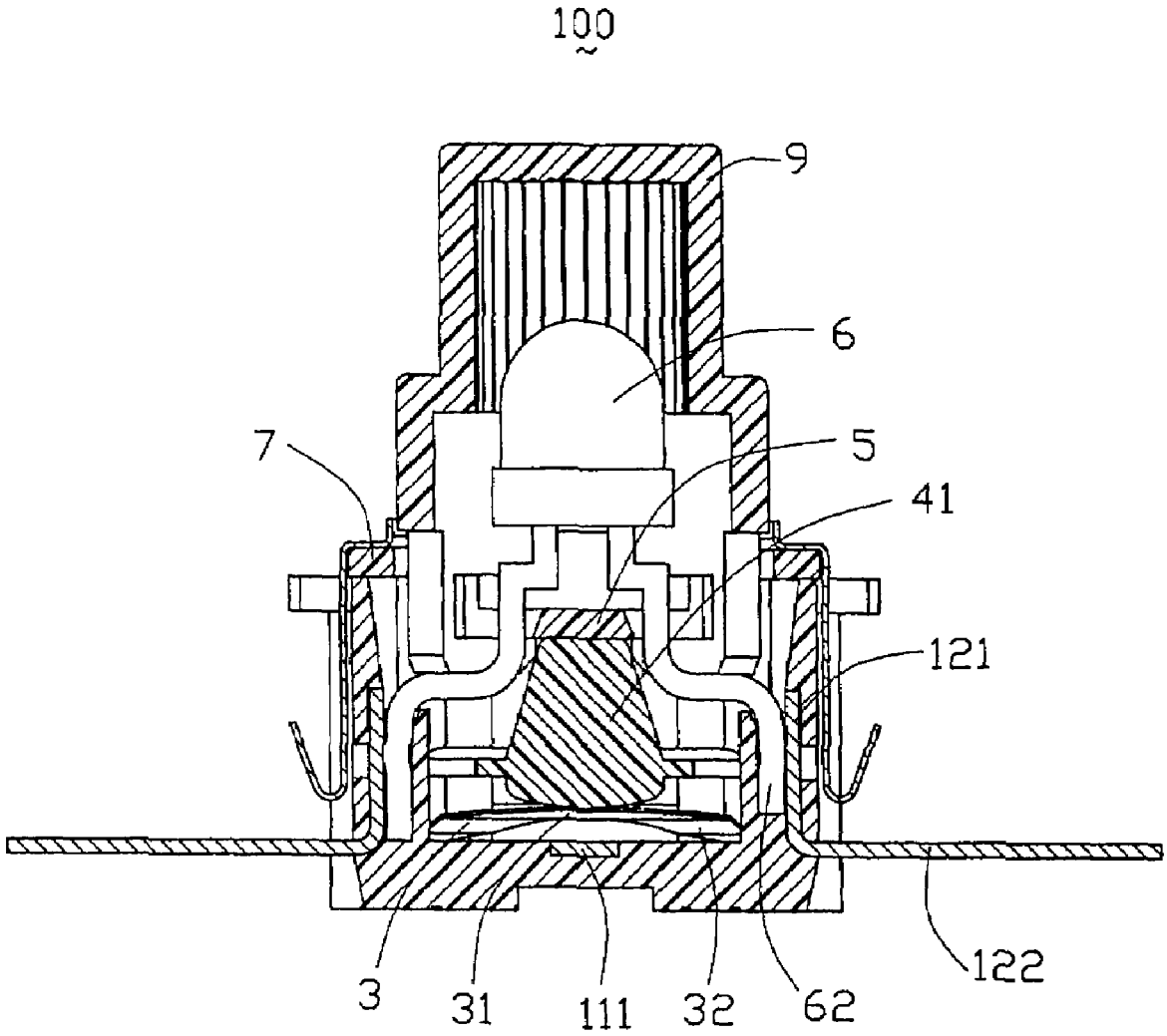
FIG. 5 is a cross-sectional view taken along line 5-5 in FIG. 4.

Referring to FIGS. 1, 4, 5, in assembly of the detect switch 100, the plurality of fixed terminals 1 are assembled to the insulative housing 2 by insert molding, with the soldering portions 113, 122, 132, 142 thereof extending outside of the insulative housing 2. The first fixed terminal 1 is disposed in the insulative housing 2, with the body portion 112 thereof embedded in the bottom wall 21 while the first contact portion 111 thereof exposed in the cavity 26. The second fixed terminals 12 are mounted on the insulative housing 2, with the second contact portions 121 thereof exposed in the engaging slots 221 for contacting with the cantilevered arms 62 of the LED 6. As for the third fixed terminal 13 and the fourth fixed terminal 14, the third and the fourth contact portions 131, 141 are accommodated in the second recesses 25 and exposed in the cavity 26.

Figure 6:
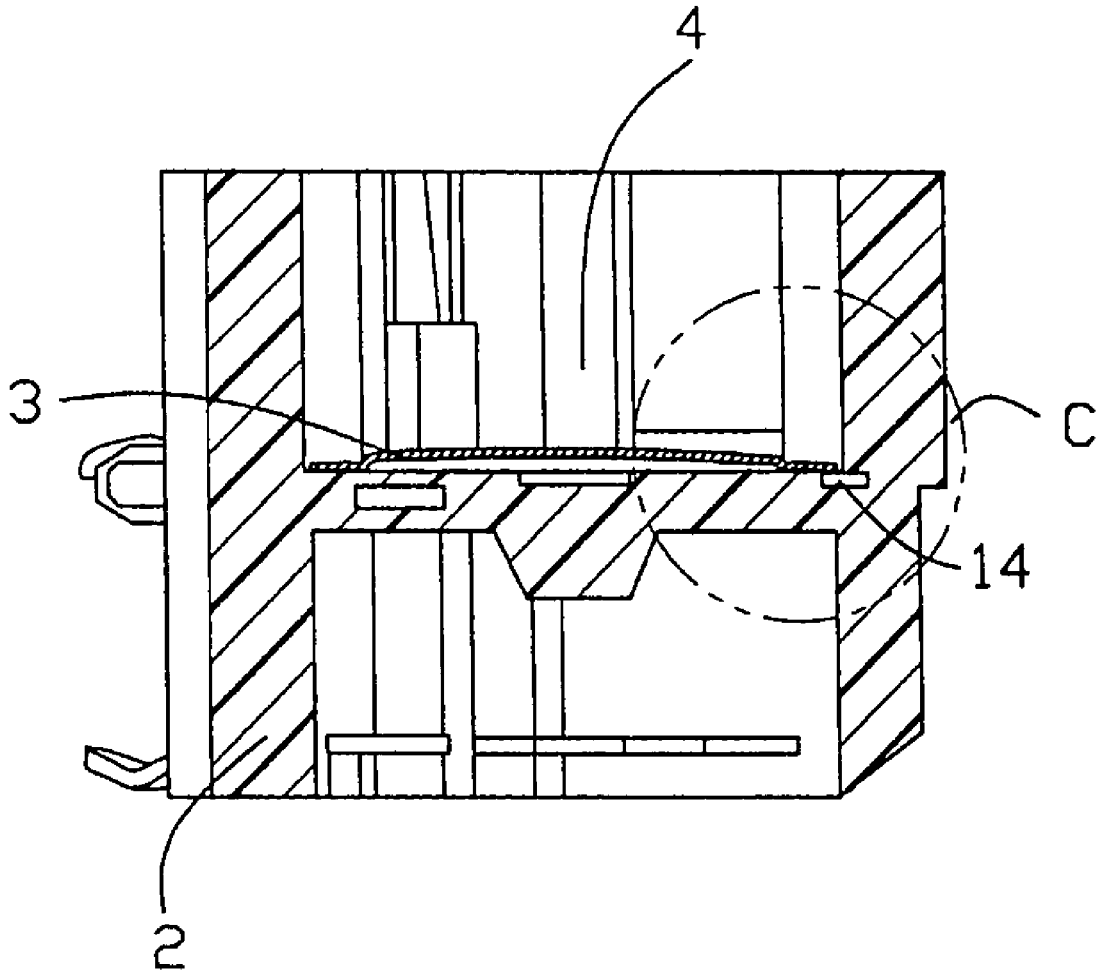
FIG. 6 is a partially enlarged cross-sectional view taken along line 5-5 in FIG. 4.
Figure 7:
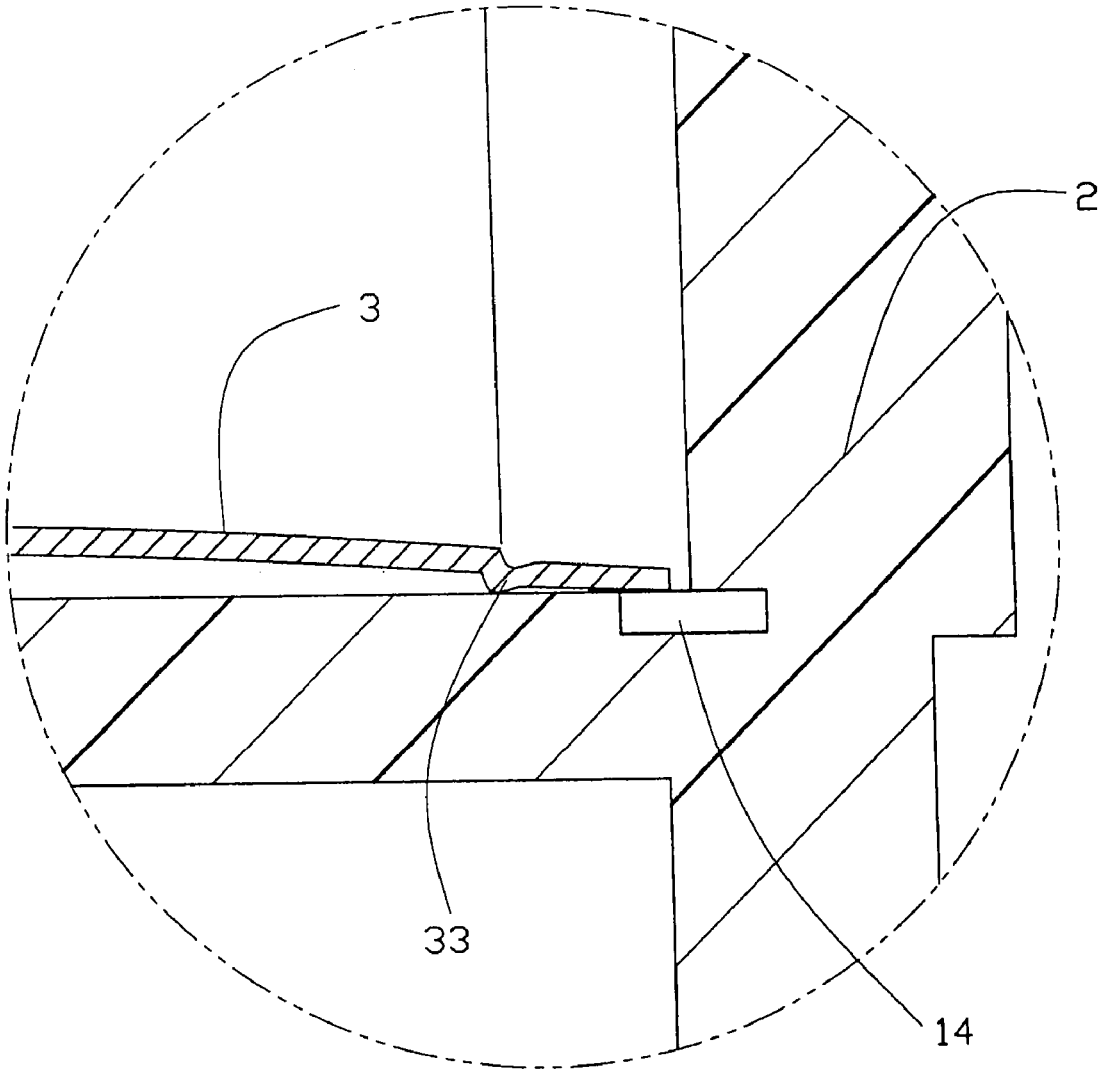
FIG. 7 is an enlarged view taken within mark C shown in FIG. 6.

The moveable contact 3 is disposed on the bottom wall 21 of the insulative housing 2, with the central contact portion 31 disposed a certain distance above the first contact portion 111. Four periphery contact portions 32 of the moveable contact 3 engage with corresponding second recesses 25. A pair of periphery contact portions 32 respectively contact with the third contact portion 131 of the third fixed terminal 13 and the fourth contact portion 141 of the fourth fixed terminal 14, with corresponding protrusions 33 respectively resisting against the third fixed terminal 13 and the bottom wall 21. Referring to FIGS. 6-7, in a normal position, the third fixed terminal 13 and the fourth fixed terminal 14 in contact with the moveable contact 3 simultaneously are therefore electrically connected.

The operator 4 is received in the cavity 26, with the button 41 thereof positioned above the central contact portion 31, and the projection beams 42 thereof retained in the second recesses 25 and corresponding to the periphery contact portions 32. The retention portion 5 is mounted on the operator 4, with a lower surface of the body portion 51 being resisted against by the button 41, and with the engaging portions 52 engaging with the first recesses 24. The LED 6 is fastened to the insulative housing 2, with the light source 61 thereof exposed above the retention portion 5, and the cantilevered arms 62 thereof extending through the indentations 53 and then being inserted into the insertion recesses 271 for contacting with the second contact portions 121.

The actuator 9 is fixed on the retention portion 5, with the cutouts 93 thereof engaging with the engaging portions 52. The base portion 92 engages with the first recesses 24, and the protrusions 94 are inserted into the corresponding second recesses 25. The light source 61 is received in the actuator 9. The gasket 7 is interposed between the cover 8 and the insulative housing 2 to ensure a proper sealing therebetween. The periphery faces 82 of the cover 8 are attached to outer surfaces of the periphery walls 22, and the engaging grooves 84 thereof engage with the tubers 231. The actuator 9 extends outwardly through the mounting hole 72 and the extension hole 81 in sequence. The detect switch 100 is assembled as a whole finally.

Figure 8:
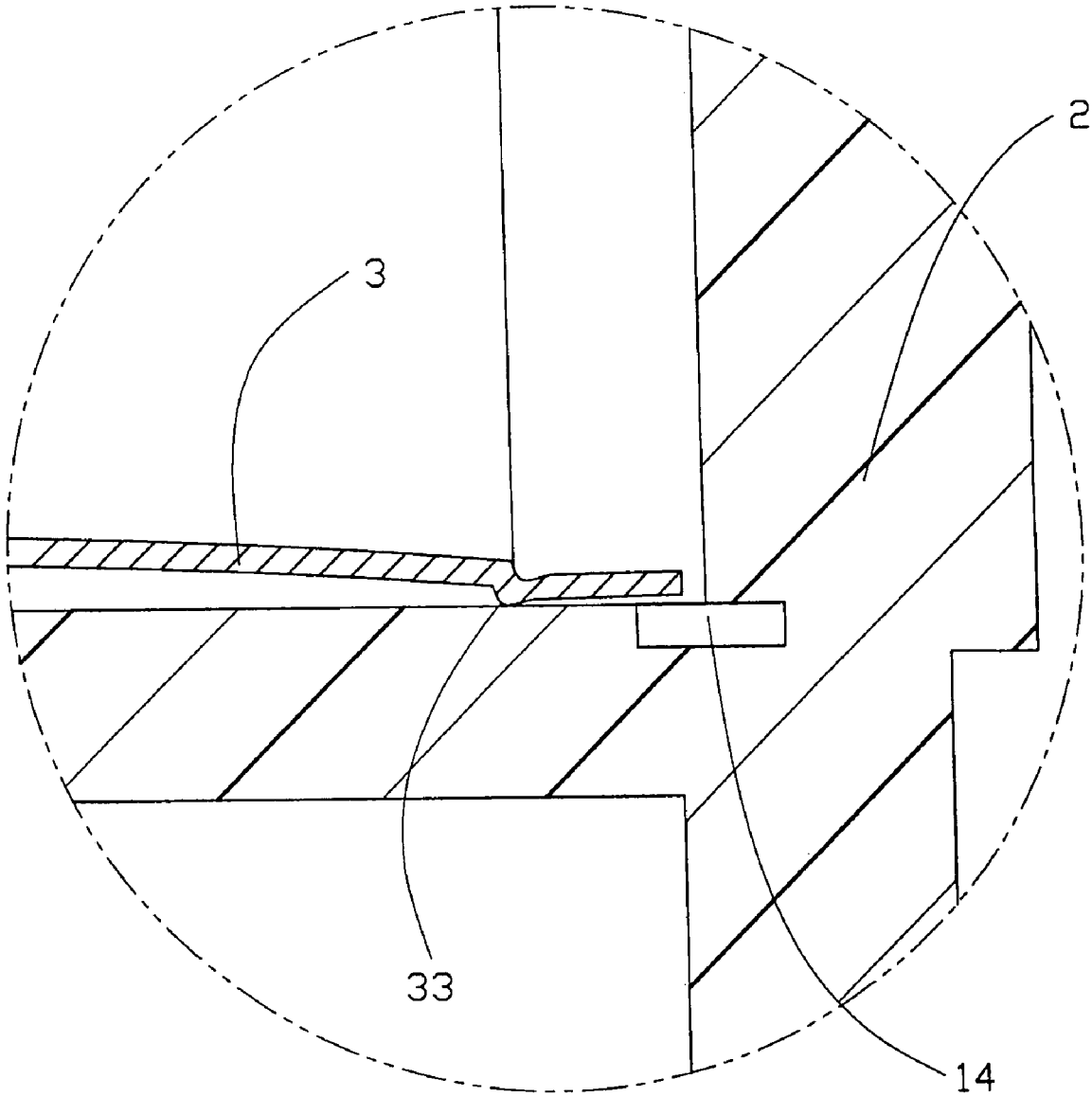
FIG. 8 is a view similar to FIG. 7 but showing the moveable contact in operation.

In operation, the actuator 9 is downwardly pushed by exerting an external force thereon. The retention portion 5 and therefore the button 41 are urged downwardly for depressing the central contact portion 31 of the moveable contact 3. The moveable contact 3 is then forced to deform and have the central contact portion 31 downwardly depressed for contacting with the first contact portion 111 of the first fixed terminal 11. At the same time, referring to FIG. 8, the periphery contact portions 32 of the moveable contact 3 contacting with the third and the fourth fixed terminals 13, 14 in a normal position are urged to tilt upwardly to leave away from corresponding fixed terminals 13, 14, due to a support movement of the protrusions 33. The third fixed terminal 13 and the fourth fixed terminal 14 are insulated from each other. Simultaneously, an electrical connection between the first fixed terminal 11 and the third fixed terminal 13 is established, due to an engagement between the first contact portion 111 and the central contact portion 31, and a resisting movement of corresponding protrusion 33 against the third fixed terminal 13.

When the external force is removed, the detect switch 100 restores itself to a normal position due to a resilient force from a deformation of the moveable contact 3 and the button 41. The electrical connection between the first fixed terminal 11 and the third fixed terminal 13 is broken, and an electrical connection between the third fixed terminal 13 and the fourth fixed terminal 14 is established again.

However, the disclosure is illustrative only, changes may be made in detail, especially in matter of shape, size, and arrangement of parts within the principles of the invention.

What is claimed is:

1. A detect switch, comprising:

an insulative housing defining a cavity therein;

a plurality of fixed terminals embedded in the insulative housing, the fixed terminals comprising a first, a fourth and a selected fixed terminals respectively provided with a first contact portion, a fourth contact portion and a selected contact portion exposed in the cavity;

a moveable contact formed with at least a pair of periphery contact portions in contact with the fourth contact portion and the selected contact portion to electrically connect the fourth and the selected fixed terminals, each periphery contact portion formed with a protrusion, one of the protrusions resisting against the selected fixed terminal; and a driving mechanism moveably assembled to the insulative housing;

wherein when the moveable contact is downwardly depressed by the driving mechanism to have a central contact portion thereof contact with the first contact portion of the first fixed terminal, the periphery contact portions of the moveable contact are urged to tilt upwardly due to a support movement of the protrusions for leaving away from corresponding fixed terminals to thereby insulate the selected fixed terminal and the fourth fixed terminal and electrically connect the first fixed terminal and the selected fixed terminal due to an engagement between the first contact portion and the central contact portion and a resisting movement of corresponding protrusion against the selected fixed terminal.

2. The detect switch as claimed in claim 1, wherein said moveable contact is formed as a dome-like shape and has four periphery contact portions radially formed around the central contact portion.

3. The detect switch as claimed in claim 2, wherein said protrusions extend downwardly from a substantially central portion of the periphery contact portions of the moveable contact.

4. The detect switch as claimed in claim 3, wherein said insulative housing comprises a bottom wall against which other protrusions are resisted.

5. The detect switch as claimed in claim 4, further comprising an electrical member provided with a light source and a pair of cantilevered arms, and wherein said fixed terminals comprises a second fixed terminal provided with a pair of second contact portions for electrically connecting with the cantilevered arms of the electrical member.

6. The detect switch as claimed in claim 5, wherein said first, second, fourth and selected fixed terminals respectively have a plurality of first, second, fourth and third soldering portions extending outside of the insulative housing, said second contact portions rising perpendicularly to the second soldering portions.

7. The detect switch as claimed in claim 5, wherein said insulative housing has four second recesses defined at four corners thereof for engaging with the fourth and the selected periphery contact portions.

8. The detect switch as claimed in claim 7, wherein said driving mechanism comprises an operator disposed above the moveable contact, an actuator moveably assembled to the insulative housing and a retention portion disposed between the actuator and the operator, the retention portion being pushed downwardly by the actuator to drive the operator.

9. The detect switch as claimed in claim 8, wherein said operator is formed with a button adapted for depressing the central contact portion and a plurality of projection beams projecting radially from a lower portion of the button.

10. The detect switch as claimed in claim 8, wherein said actuator comprises a base portion received in the cavity, and a plurality of protrusions formed around the base portion for engaging with the second recesses.

11. The detect switch as claimed in claim 10, wherein said retention portion is provided with a pair of engaging portions, and said base portion of the actuator has a pair of cutouts each defined between two adjacent protrusions for engaging with a corresponding engaging portion.

12. The detect switch as claimed in claim 11, wherein said retention portion is formed with a body portion, a pair of indentations symmetrically defined on the body portion for extension of the cantilevered arms of the electrical member.

13. The detect switch as claimed in claim 8, further comprising a cover attached to a top of the insulative housing, and wherein said cover has a top wall defining an extension hole for extension of said actuator, a pair of periphery faces attaching to an outer face of the insulative housing, and a pair of bent portions defining a pair of engaging grooves for engaging with a pair of tubers formed on the insulative housing.

14. A detect switch comprising:

an insulative housing;

first and second fixed contacts retained in the housing; and a deflectable contact located in and movable with regard to the housing, said deflectable contact being located above the first and the second fixed contacts and defining a fulcrum between the first and the second fixed contacts; wherein said deflectable contact is constantly electrically and mechanically engaged with the first fixed contact and disengaged from the second fixed contact during a relaxed status while disengaged from the first fixed contact and engaged with the second fixed contact instead via deflection about said fulcrum when a force is imposed thereon.

15. The detect switch as claimed in claim 14, wherein said deflection results from said force imposed upon a point between the second fixed contact and the fulcrum.

16. The detect switch as claimed in claim 14, wherein said deflectable contact is circular and the first fixed contact is located around a periphery region while the second fixed contact is located around a center region thereof.

17. The detect switch as claimed in claim 14, wherein a first direction, along which said force is exerted, is parallel with a second direction, along which engagement and disengaged between the deflectable contact and the first and second contacts occur.

18. The detect switch as claimed in claim 14, wherein said fulcrum is constantly engaged with the housing.

19. A detect switch comprising:

an insulative housing;

first and second fixed contacts retained in the housing; and a deflectable contact located in and movable with regard to the housing, said deflectable contact defining a center region located above the first fixed contact, and a periphery region located above the second fixed contact; wherein said deflectable contact is constantly electrically and mechanically engaged with the first fixed contact and disengaged from the second fixed contact during a relaxed status while disengaged from the first fixed contact and engaged with the second fixed contact instead via deflection about said fulcrum when a force is imposed thereon.

20. The detect switch as claimed in claim 19, wherein said deflectable contact define a fulcrum to resist said deflection.

* * * * *